United States Patent [19]

McCloskey et al.

[11] 3,992,754

[45] *Nov. 23, 1976

[54] METHOD FOR CLEANING BAGASSE FIBER USING A U-SHAPED WASH PATH

[75] Inventors: John T. McCloskey, Richardson, Tex.; Eduardo J. Villavicencio, Mexico City, Mexico

[73] Assignee: Process Evaluation and Development Corporation, Dallas, Tex.

[ * ] Notice: The portion of the term of this patent subsequent to Apr. 15, 1992, has been disclaimed.

[22] Filed: Feb. 5, 1975

[21] Appl. No.: 547,278

Related U.S. Application Data

[62] Division of Ser. No. 355,179, April 27, 1973, Pat. No. 3,877,110.

[52] U.S. Cl. ..... 19/66 R; 19/7; 209/173

[51] Int. Cl.² ..... D01G 1/00

[58] Field of Search ..... 19/66 R, 7, 8, 34; 209/173, 461, 463, 464, 488, 494, 495, 18, 361

[56] References Cited

UNITED STATES PATENTS

| | | | |
|---|---|---|---|
| 1,733,256 | 10/1929 | Gardner | 19/66 R |
| 2,711,822 | 6/1955 | Novak | 209/173 X |
| 3,688,345 | 9/1972 | Villavicencio | 19/7 |

FOREIGN PATENTS OR APPLICATIONS

| | | | |
|---|---|---|---|
| 1,273,788 | 9/1961 | France | 19/66 R |
| 1,552,514 | 11/1968 | France | 19/66 R |
| 15,783 | 1895 | United Kingdom | 19/66 R |
| 269,064 | 3/1971 | U.S.S.R. | 19/66 R |

*Primary Examiner*—Dorsey Newton
*Attorney, Agent, or Firm*—Michael J. McGreal

[57] ABSTRACT

Method for cleaning fibrous vegetable materials to remove trash components (such as coarse sand, stones, rocks, metallic particles, shives, dirt and the like).

4 Claims, 5 Drawing Figures

METHOD FOR CLEANING BAGASSE FIBER USING A U-SHAPED WASH PATH

This application is a division application of U.S. Ser. No. 355,179, filed Apr. 27, 1973, now U.S. Pat. No. 3,877,110.

This invention relates to cleaning apparatus and method. In particular it relates to apparatus and method for cleaning fibrous vegetable materials intended for use in preparing paper pulp to remove undesired trash components such as sand, stones, rocks, metallic particles, shives, dirt and similar impurities. The invention is especially suitable for cleaning fibers of sugarcane bagasse but is also suitable for cleaning fibers of other vegetable materials such as straw, flax, rice hulls, bamboo, esparto, hemp, waste jute, and the like.

The prior art has suggested several methods and apparatus for cleaning papermaking wood fibers and pulp. Representative examples of these known methods include those described in Freeman - U.S. Pat. No. 1,988,416 (1935); Lea et al — U.S. Pat. No. 3,367,495 (1968); and Reinhall — U.S. Pat. No. 3,279,597 (1966). Tilby — U.S. Pat. No. 3,690,358 (1972) discloses a forced air detrashing of sugarcane stalks.

It is an object of this invention to provide a new method and apparatus for cleaning papermaking fibers comprising vegetable materials such as sugarcane bagasse. Other objects and advantages of the invention will become apparent from the following more detailed description.

The invention will be described in conjunction with the accompanying drawings, in which.

Figure 4:
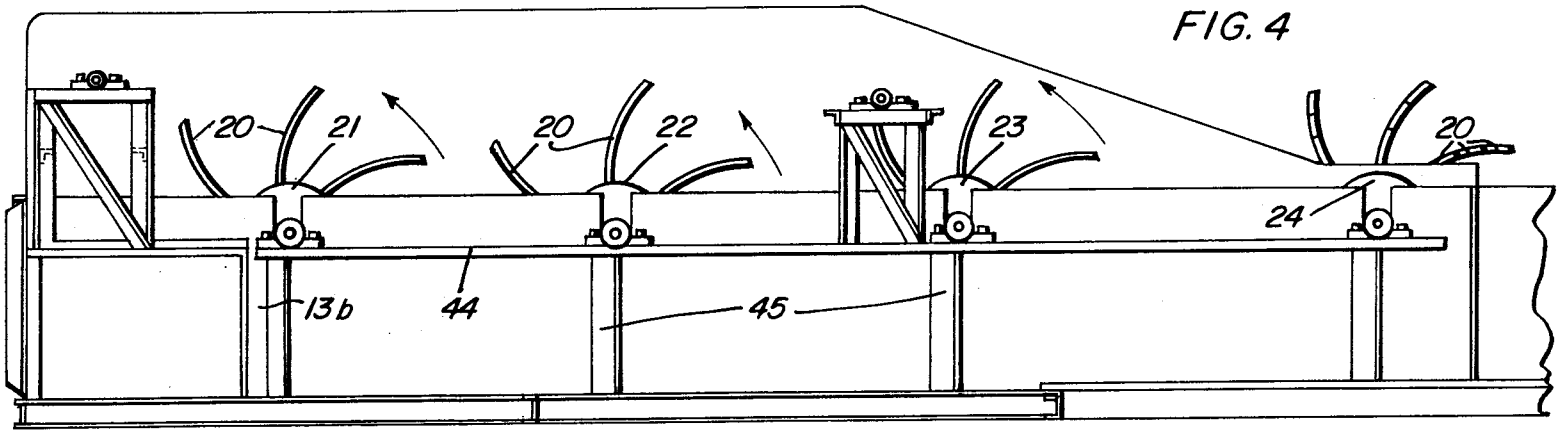
FIG. 4 is an elevational view, partially in section, taken generally on line 4—4 of FIG. 1.
Figure 5:
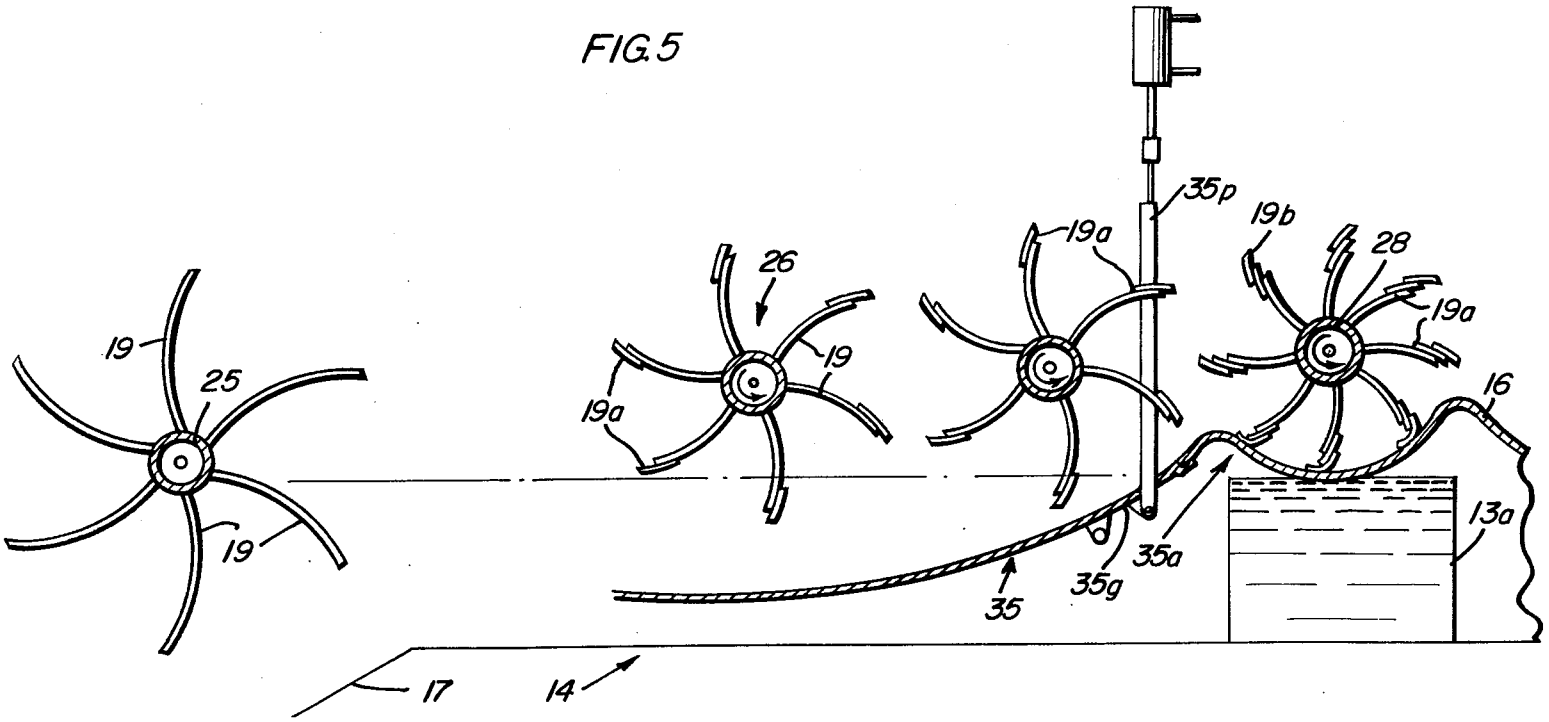
FIG. 5 is an elevational view, partially in section, taken generally on line 5—5 of FIG. 5.

Referring to the drawing it is seen that the illustrated cleaning apparatus of this invention generally designated as 10, includes a U-shaped wash tank or trough 11 comprising outer side wall 12, inner side wall 13, an interconnecting bottom wall 14 and an open top. The inner side wall 13 has openings **13*a* and 13*b* (as seen in FIGS. 5 and 4; respectively) at the outlet end 16 and inlet end 15, respectively, of the device to permit recirculation of cleaning fluid. The apparatus could be linear, in which case separate provisions would be required for recirculation. The illustrated U-shape design gives a more compact unit and simplified recirculation. At the extremity of one leg of the tank 11 there is an inlet chute 15 for feeding the fibrous material to be cleaned to roller 21; and at the extremity of the other leg there is an outlet chute 16 for cleaned fibers. Disposed transversely of the tank are a plurality of feed rollers. In the device as illustrated there are eight such rollers, designated as 21, 22, 23, 24, 25, 26, 27, and 28.**

The feed rollers 21, 22 and 23 have a plurality of curved fingers of uniform length secured to their outer circumference, such as the fingers 20 shown on roller 22. Rollers 24 and 25 have similar curved fingers except that the fingers on these rollers are of varying length. All of the fingers 20 on rollers 21 through 25 are curved away from the direction of rotation of the rollers (see, for example, FIG. 4). As the rollers 21 through 25 rotate, these fingers cause the fibrous material fed through inlet chute 15 to be positively fed from the inlet end towards the outlet end of the tank. At the same time the fingers cause the fibrous material to be repeatedly "dunked" or immersed in the cleaning fluid maintained in the tank. As a result of this repeated immersion and reimmersion in the cleaning fluid, foreign materials such as sand, dirt, stones, shives (knots) and the like are separated from the bulk of the fibrous material and because of their greater density begin to settle out into the cleaning fluid.

At the loop in the U-shaped cleaning tank the fingers or pins are arranged in a frustoconical feed pattern on the rollers 24 and 25. This pattern on roller 25 at the exit or outlet side of the loop has a larger base diameter than the pattern on roller 24. The smaller feed pattern diameter of roller 24 near the center part of the tank (the midfeather) reduces the linear velocity of the fibers so that they can suitably travel around the bend in the U-shaped tank. Roller 25 has a larger diameter feed pattern at the midfeather to accelerate the fibers after they pass the bend.

Figure 1:
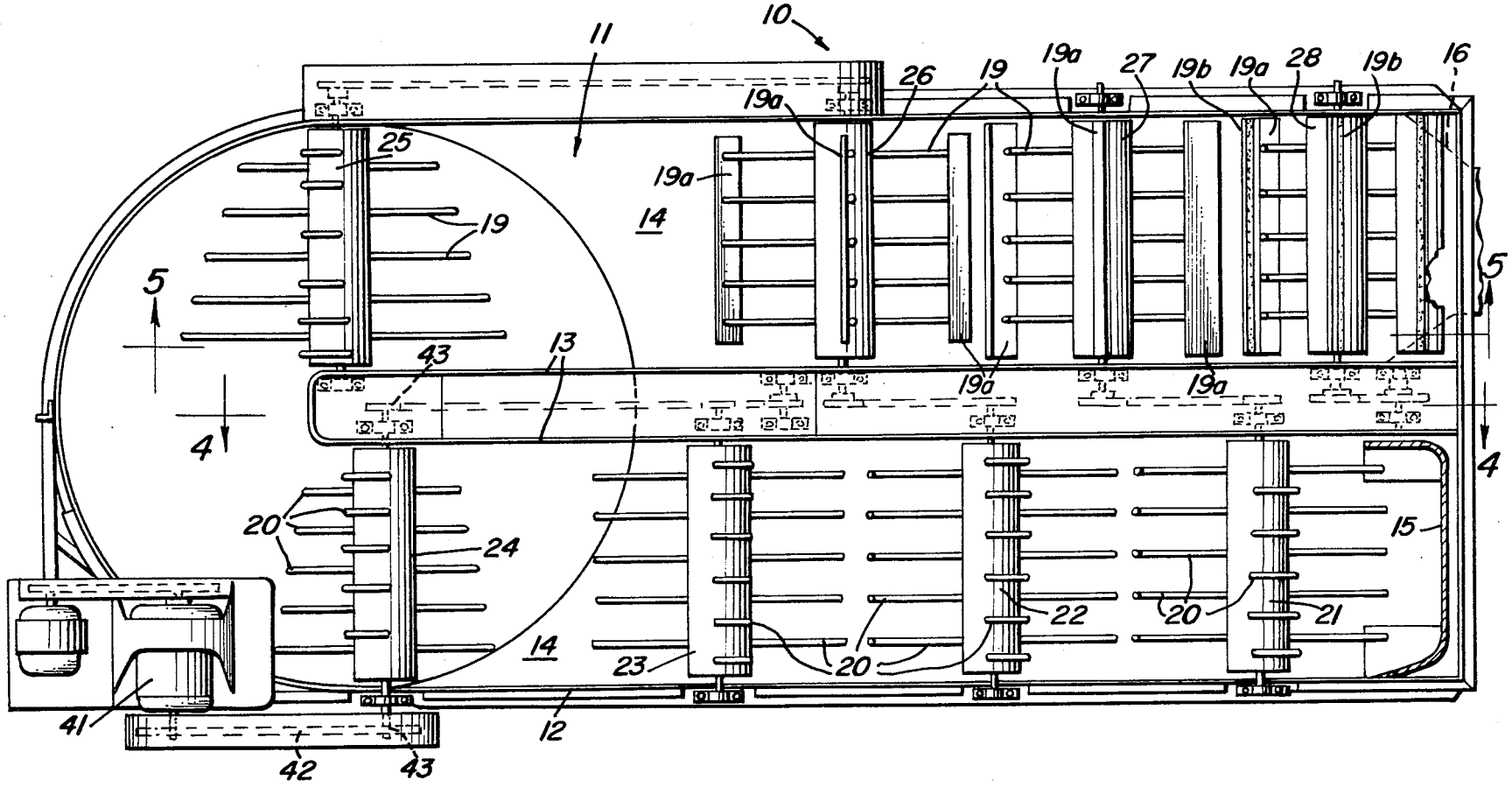
FIG. 1 is a plan view showing one possible general arrangement of the apparatus of the present invention.
Figure 2:
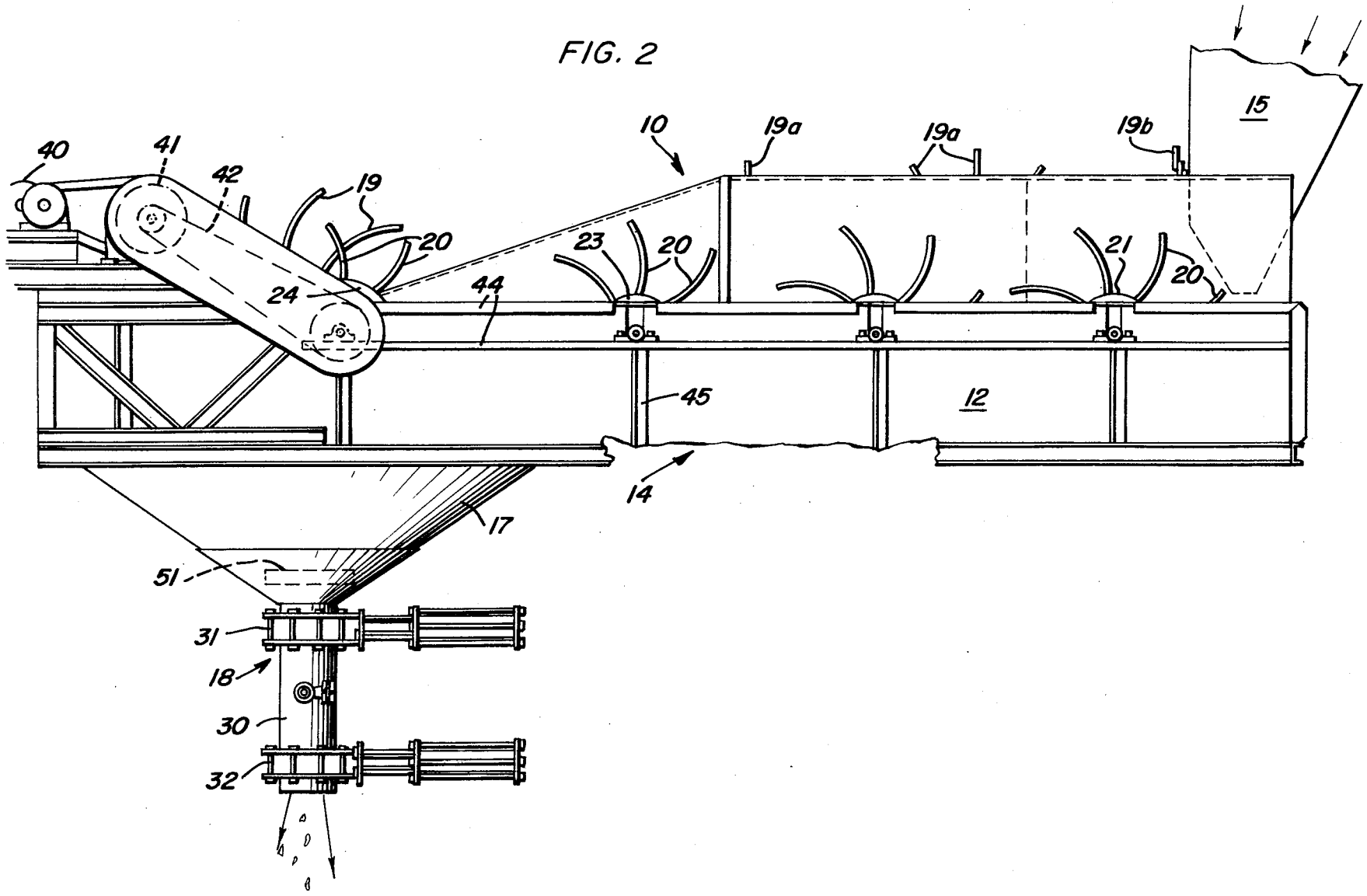
FIG. 2 is a front view, in elevation, of the apparatus shown in FIG. 1.
Figure 3:
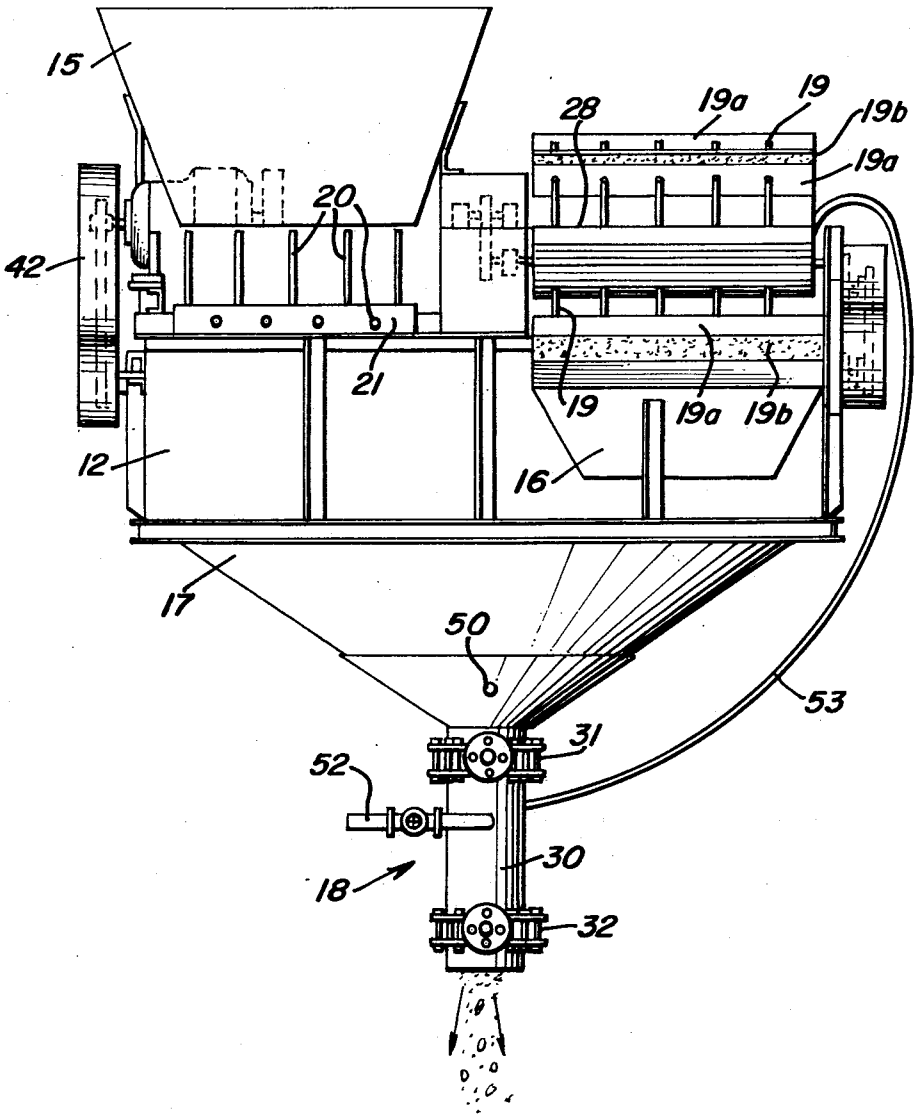
FIG. 3 is an end view, in elevation, taken from the right side of FIG. 1.

As best seen in FIGS. 2 and 3 the bottom of the cleaning tank has an inverted sloping cone section 17 which is also located at the loop or bend of the overall U-shape. At the apex of this conical section there is a trash discharge device 18. This includes a cyclindrical chamber 30 and top and bottom gate valves 31, 32. The top gate valve 31 is normally open, permitting collection of settled out foreign materials in the chamber 30. Periodically, this valve is closed and bottom valve 32 is opened, discharging the collected trash. Then the bottom valve is closed again, the chamber 30 is refilled with water from a separate source 52 (FIG. 3) and finally the top valve 31 is reopened and foreign materials settling in cone section 17 again begin to collect in the chamber 30. The chamber 30 may also be provided with an air vent line 53 as shown in FIG. 3. The operation of the trash discharge device is easily automated if desired and permits trouble-free periodic removal of collected foreign materials without interrupting the operation of cleaning tank 11.

If desired or necessary for efficient cleaning and separation of fibrous material from its associated foreign materials the device may include means for introducing air bubbles to assist in refloating cleaned fibrous material to the top of the body of cleaning fluid. Such means could include, for example, the air pipe 50 and sparger 51, as shown in FIG. 2, situated in the inverted conical section 17 of tank 11 just above discharge device 18.

Cleaned fibrous materials are now caused to continue their travel toward the exit end of the tank 11 by the rollers 26, 27, 28. These rollers have a plurality of curved fingers (e.g., fingers 19 on roller 26) like those on rollers 21 through 23 of uniform length and curved away from the direction of rotation. On rollers 26 and 27 smooth metal plate **19*a* are attached at the ends of and across the respective rows of fingers 19 and serve as paddles for positive feed of the cleaned fibers toward the discharge chute. On roller 28 the plates 19*a* are further provided with rubber flaps 19*b* which extend slightly beyond the end of fingers 19** to provide a squeegee-like flap action.

As best seen in FIG. 2 the rollers 26, 27, 28 in the outlet leg of the U-shaped tank are positioned for axial rotation on a plane above the rollers 21, 22, 23, 24 of the inlet leg. As seen in FIG. 5 this causes the cleaned fibrous materials to be forced up an incline 35 at the end of which the mat of fibers is permitted to drain through perforated plate 35*a* and may be compressed if desired to reduce the cleaning fluid (usually water) content to the desired level. After passing roller 28 the cleaned fibrous materials slide down inclined discharge chute 16 to further processing. The drained water falls back into the tank and recirculates to the inlet side of the tank through openings 13*a* and 13*b*.

The apparatus includes a suitable power source such as motor 40 for driving the various rollers 21 through 28 via, for example, gear reducer 41 and drive chains (such as chain 42) cooperating with sprockets at each end of the respective rollers (e.g., sprockets 43 on roller 24). The particular means chosen for driving the rollers is not critical and the illustrated drive as described above should be considered as exemplary of a number of possible means.

The overall apparatus is suitably supported in framing means, such as beams 44 and struts 45, with the axial drive shafts of each roller 21 through 28 suitably journalled on the beams in bearing blocks of the usual construction.

In operation fibrous material to be cleaned, such as "dry" or "moist" depithed sugarcane bagasse (see. e.g., U.S. Pat. No. 3,537,142 granted Nov. 3, 1970) is introduced via inlet 15, into the tank 11, which has previously been filled to a suitable level with water or other desired liquid medium in which the fibrous material will normally tend to float. For obvious reasons of economy water will be the preferred liquid medium. The fluid level is usually maintained automatically through use of an automatic valve and a suitable overflow. It has been observed that best operation is usually obtained when the water level in the illustrated apparatus is maintained about 6 inches below the axial center line of rollers 21 through 25.

The mat of fibers thus introduced into the tank is transported by rollers 21 through 25 through the U-shaped path of the tank and in the course of this travel is repeatedly dunked under the water by the fingers carried on the rollers. As a result of this repeated dunking any dense foreign material present in the fibrous material entering the tank will sink towards the bottom of the tank and eventually will be carried to and slide down the steeply inclined (minimum 35°) conical bottom section 17 at the U-bend of the tank. This foreign material collects in chamber 30 from which it is periodically discharged in the manner described above, without upsetting or interrupting the cleaning tank. On the other hand the fibrous material being cleaned has a natural tendency to refloat to the top of the liquid in the tank, which may be assisted, if desired or necessary, by introduction of small air bubbles into the liquid.

The speed of travel of the fibrous mat through the inlet leg of the tank and the length of the inlet leg is appropriately chosen to permit separation of the fibers and the foreign materials associated therewith. If the dirty fibrous material is transported too fast the foreign materials will not properly settle out whereas if the transport speed is too slow there is a tendency for some of the more dense fibrous material to settle out along with the trash. A few routine experiments will suffice for the skilled worker to determine the appropriate speed for his intended application.

Before being discharged from the tank the cleaned fibrous material is forced up the inclined plate 35 to the perforated plate 35*a* through which excess water or other liquid cleaning medium is permitted to drain back into the tank. Proper design of the inclined plate 35, perforated plate 35*a* and cooperating rollers 26 through 28 permits one to achieve the desired liquid content in the fiber discharged from chute 16. If necessary pressure rollers may be provided at the discharge end of the tank to assist in liquid removal from the fibrous material. If desired one may provide a bypass gate section 35*g* (FIG. 5) in plate 35 operated for example by piston mechanism 35*p* (FIG. 5) when desirable or necessary to recirculate fibrous material if there is a jam-up at the outlet end of the tank or if it is observed that the product then under processing requires further cleaning.

An apparatus of the type illustrated has been tested for the cleaning of dry depithed bagasse fragments prepared through use of the apparatus and method described in U.S. Pat. No. 3,537,142 prior to secondary wet depithing in accordance with the procedure schematically illustrated in FIG. 2 of related U.S. Pat. No. 3,688,342 granted Sept. 5, 1972; i.e., the feed material to the cleaning tank 11 is the fibrous fraction of dry depithed raw bagasse and the cleaned fibers are discharged from tank 11 directly to the secondary wet depither. The overall tank dimensions were about 22 feet long by 10 feet wide with the inside width of the tank legs being about 4 feet. The inverted frustoconical section 17 had a base diameter of about 9 feet tapering at an angle of 35° to a 12 inch outlet at the apex. The dunking rollers 21, 22, 23, 24 and 25 were equipped with slightly curved fingers or pins 20 so that they would not catch the fibers as they emerge from the water. On the rollers 21 through 23 these fingers were approximately 18 inches long, mounted on rolls about 1 foot in diameter. There were six rows of pins around the circumference of the rollers with the pins spaced about 10 inches apart in the rows and staggered with respect to the pins in the adjacent rows. The rolls were rotated at about 18 revolutions per minute giving an average linear speed of about 40 feet per minute to the fibers being transported through the tank. The fibers were fed to the tank at a rate of about 5.8 tons per hour and in a floating mat about one foot thick on top of the water in the tank. This feed rate together with the above average linear speed of the rollers provided an average residence time of about one minute between the inlet chute 15 and outlet chute 16, approximately evenly divided between the inlet leg and the outlet leg of the U-shaped tank. The rollers 26, 27, 28 were the same 12 inch diameter and otherwise similar to rollers 21, 22, 23 except that they had smooth metal plates 19*a* welded to the curved fingers 19 on rollers 26 through 28 and extending across the width of the rollers. The additional rubber flaps 19*b* attached to the to the metal plates 19*a* on roller 28 rub against the perforated plate 35*a* and keep the holes clean. There were six metal plates on the rollers 26 and 27 and twelve metal plates with associated rubber flaps on roller 28.

This test gave excellent results. There was essentially complete removal of all junk including rocks, gravel, coarse sand, metals, rubber, plastics, burnt rind and dense, poor quality fiber bundles such as from cane joints. Some of the finer sand imbedded in the fibers did not settle out in the tank, but the loosening of the sand in the tank did assist its complete removal from the bagasse fiber in the subsequent wet depithing step. More complete extraction of sugar and other solubles in the fiber was observed than was previously possible with the wet depither alone. The improved soaking of the bagasse in the cleaning tank made the pith and fiber more easily separated in the wet depither. This soaking also increases the flexibility of the fiber bundles and thus leads to less fiber breakage and/or loss in the wet depither. Also, the fiber bundles were more easily opened so that during pulping of the final wet depithed fibers the cooking liquor was able to penetrate the bundles more easily than previously possible. This gave more uniform cooking, lower chemical demand, and fewer shives.

What is claimed is:

1. The method for removing associated foreign materials such as stones, gravel, coarse sand, and the like from fibrous vegetable materials by contacting said fibrous vegetable materials with a washing liquid in a U-shaped washing path wherein the loop of the U region of said path is substantially deeper than the remainder of said U-shaped path comprising:

a. repeatedly immersing and refloating the fibrous material in a wash liquid to separate associated foreign material therefrom and simultaneously transport said fibrous material and separated foreign material to the loop region of the U-shaped washing path;

b. repeatedly immersing and refloating the fibrous material in said loop region to separate foreign associated material therefrom and simultaneously transport said fibrous material through said loop region while (i) changing the direction of transport of said fibrous material, (ii) permitting said separated foreign material to fall to the bottom of said loop region; and (iii) removing foreign material from the washing path at the bottom of said loop region;

c. transporting the fibrous material from said loop region and removing the fibrous material from the wash liquid; and d. removing excess wash liquid from said fibrous material and allowing said excess wash liquid to flow back into said washer path.

2. The method as defined in claim 1 in which the wash liquid for the fibrous material is water.

3. The method as defined in claim 2 in which the water is recovered from the cleaned fibrous material and recirculated for the immersing step.

4. The method as defined in claim 1 wherein said fibrous material is bagasse.

* * * * *